US005799586A

United States Patent [19]

Teixidor Casanovas et al.

[11] Patent Number: 5,799,586

[45] Date of Patent: Sep. 1, 1998

[54] LOADING PLATFORM WITH DISMOUNTABLE LEGS AND METHOD FOR MANUFACTURING LOADING PLATFORMS WITH DISMOUNT LEGS

[75] Inventors: Jaime Teixidor Casanovas, Esparreguera; Leopoldo Amaya Mele, Granollers, both of Spain

[73] Assignee: Videcart S.A., Ibiricu de Eguues, Spain

[21] Appl. No.: 776,181

[22] PCT Filed: May 9, 1996

[86] PCT No.: PCT/ES96/00100

§ 371 Date: Mar. 31, 1997

§ 102(e) Date: Mar. 31, 1997

[87] PCT Pub. No.: WO96/35620

PCT Pub. Date: Nov. 14, 1996

[30] Foreign Application Priority Data

May 10, 1995 [ES] Spain ..... 9500892
Nov. 8, 1995 [ES] Spain ..... 9502178

[51] Int. Cl.[6] ..... B65D 19/12

[52] U.S. Cl. ..... 108/56.3; 108/51.3

[58] Field of Search ..... 108/51.3, 56.3, 108/56.1, 51.11

[56] References Cited

U.S. PATENT DOCUMENTS

| | | | |
|---|---|---|---|
| 3,664,272 | 5/1972 | Sanders | 108/56.3 X |
| 3,685,463 | 8/1972 | Francis | 108/56.3 |
| 3,691,964 | 9/1972 | Larson et al. | 108/56.3 |
| 3,804,032 | 4/1974 | Baucom | 108/56.3 |
| 4,425,852 | 1/1984 | Riviere | 108/56.3 |
| 5,193,464 | 3/1993 | Morden | 108/56.3 |
| 5,367,961 | 11/1994 | Arai et al. | 108/56.3 |
| 5,535,668 | 7/1996 | Besaw et al. | 108/51.3 |
| 5,567,263 | 10/1996 | Giasi | 108/51.3 X |
| 5,588,374 | 12/1996 | Urbach | 108/56.3 |

FOREIGN PATENT DOCUMENTS

| | | | |
|---|---|---|---|
| 2128297 | 4/1980 | Germany | 108/56.3 |
| 3521830 | 1/1987 | Germany | 108/56.3 |

*Primary Examiner*—Jose V. Chen
*Attorney, Agent, or Firm*—Steinberg & Raskin, P.C.

[57] ABSTRACT

The loading platform is comprised of a plate (1) formed of three layers (2, 4, 6) with circular openings (3, 5, 7), which define an internal space (9) accessible through a notch or prolongation (8) of the opening (7) for housing a circular crown-shaped fin (11) of a leg (10), with bevel edges (13, 13*a*) to facilitate the introduction and removal of the fin. In one embodiment, the openings (103, 105, 107) are rectangular and the legs (110) have a truncopyramidal shape. The legs may be incorporated and dismounted with respect to the plate. The plates (201, 208) have inner matching cuts (215, 216) which form gripping recesses (217). The legs (203) have internal columns which reach the upper base thereof, and are formed by hollow and truncated elevations (205) or by separate parts (206) acting as a reinforcement to increase the loading capacity of the platform.

20 Claims, 3 Drawing Sheets

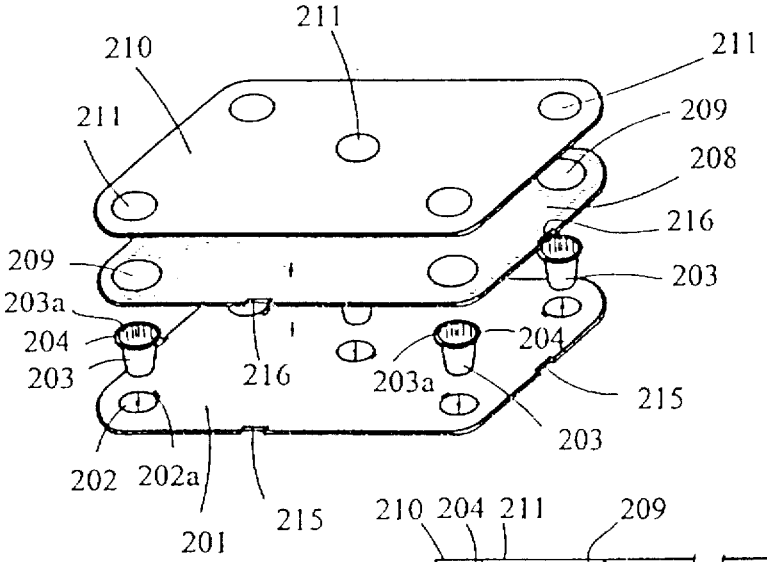
FIG. 14
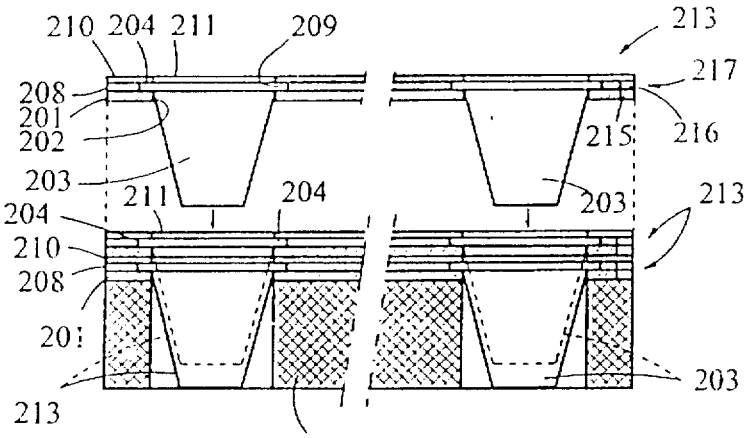
FIG. 15
FIG. 16
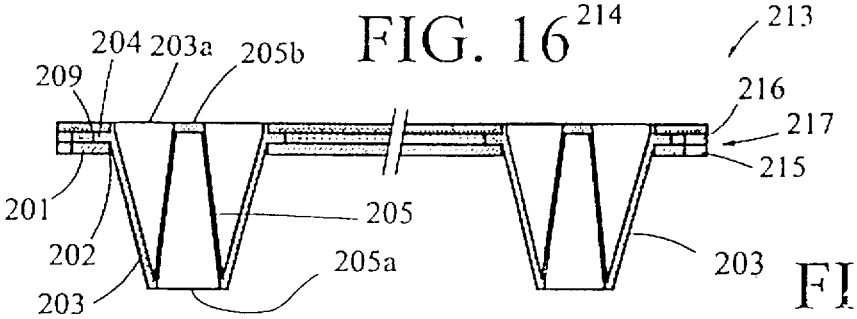
FIG. 18
FIG. 17
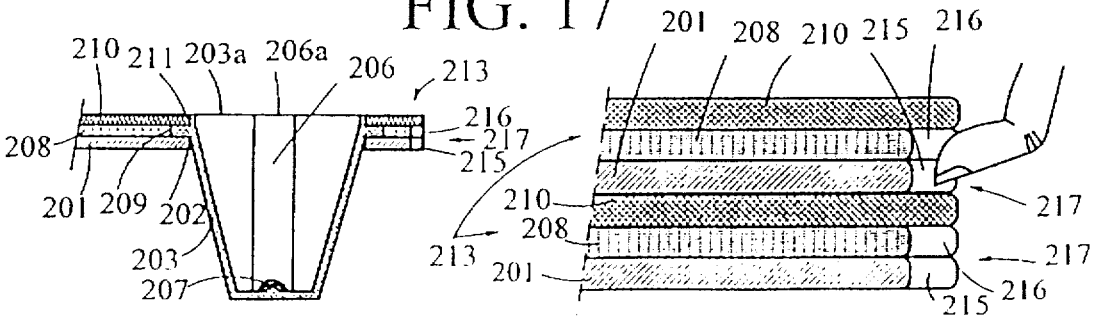

LOADING PLATFORM WITH DISMOUNTABLE LEGS AND METHOD FOR MANUFACTURING LOADING PLATFORMS WITH DISMOUNT LEGS

The present invention relates to a loading platform with dismountable legs, for the transportation and warehousing of goods, and having the special feature of its supporting legs being dismountable in order to facilitate replacement when damaged and, at the same time, reduce the space occupied by the empty platform when it is not in use. The design also permits the empty platforms to be stacked without removing the legs, the legs of each platform slotting into those of the one immediately next to it. In this case the platforms present an incut on the edge in order to facilitate grasping with the fingers.

BACKGROUND OF THE INVENTION

Known in the art are various types of platforms which comprise several layers of cardboard superimposed and glued, provided with circular openings surrounded by a lowered section or depression resembling a circular crown situated on the top side of the platform. Into these openings are incorporated in removable manner the same number dismountable legs of inverted truncoconical shape, which have at their upper bases pairs of projecting, radial, parallel fins in the form of a circular crown, of which fins the ones occupying a higher position have an interruption or opening delimited by two bevelled edges which form a substantially helicoidal edge. The lowered section or depression which surrounds each opening of the platform is provided with a cut through which the upper radial fin is inserted by means of a rotating movement similar to that of screwing, so that, once the leg has been inserted into the opening, the depression or lowered section is trapped between the two fins and the leg is immobilized.

Subsequent studies carried out on this type of platforms have permitted the conclusion to be reached that the presence of the two radial fins with which the legs of the platform are provided increases the cost of the platforms and hinders the operations of fitting the legs onto the platform and removing them from it.

Moreover, the known embodiments present limitations in respect of the shape of the fins, which have to be circular and are not very suitable for legs of non-circular outline, for example, rectangular legs. Furthermore, if the platforms are stacked without removing the legs it is difficult to separate the platforms from each other.

DESCRIPTION OF THE INVENTION

The loading platform with dismountable legs of the invention, in which the legs have a single fin, which can be circular or rectangular, has been designed in order to provide a solution to the disadvantages outlined.

The loading platform with dismountable legs is composed of one or more layers glued to each other, preferably made of cardboard, each layer provided with regularly distributed openings which match those of the other layers, into which openings are inserted as many dismountable legs provided with a radial fin with an incut. The fin has opposite edges with slopes by way of ramps to facilitate the introduction and removal thereof in a space which surrounds the outline of, at least, the greater part of each opening, through a notch or widened section of same, which forms an inlet through which the aforesaid fin penetrates. On the basis of this embodiment, the platform is essentially characterized in that the space which follows the outline of the opening is situated between two layers of the plate, while each leg has a single external radial fin which, once mounted on the plate, is trapped between the two layers.

More specifically, the plate comprises three layers, of which the upper and lower layers have identical matching openings. The openings of the lower layer have, at least, one notch or widened section for introduction of the fin of the corresponding leg. The intermediate plate has similar openings which match those of the upper and lower layers, but are of larger dimensions, thereby forming the space in which the fin of the corresponding leg is housed.

In one possible embodiment, the legs of the platform are of truncoconical shape, with a fin of circular outline. The openings are likewise of circular outline.

Advantageously, one of the edges which limit the incut of the fin is bent in the form of a ramp to assist its removal from the space in which it is housed.

The fin of each leg is slightly separated from the upper edge of same, at a distance equivalent to the thickness of the upper layer, so that when the leg is fitted into the corresponding openings of the plate its upper edge is in coplanar position with respect to the upper side of same.

The openings of the layers of the plate are also designed to have an approximately rectangular outline. The opening of the lower layer has some lateral notches or widened sections near one of its ends for insertion of the fin which surrounds each leg. Between the two notches is defined a flexible wing which acts as a stop to immobilize the leg once it has been fitted into the corresponding openings of the layers. In this embodiment of the platform, the fin of each leg has an outline similar to a "U", with two straight branches running parallel to each other, so that it passes around the upper part of the leg, except on one side.

The ends of the branches of the fin are bent in the form of a ramp to facilitate its removal from the space in which it is housed.

In a more specific embodiment, the legs can be of rectangular truncopyramidal shape, around the larger base of which there projects the radial fin which surrounds two of its larger sides and one of the smaller sides, while the other smaller side has no fin.

At least one of the layers which form the platform has an incut on its edge forming a recess to facilitate gripping the platform when it is stacked with other empty platforms.

More specifically, the lower layer and the immediately upper layer of the platform are provided with matching incuts.

From the lower base of the legs of the platform there projects an internal elevation by way of column. The upper base of same is at the height of the open base of the corresponding leg.

In a possible embodiment, the elevation which projects from the lower base of the legs of the platform is hollow, forms a single body moulded with the leg itself and has an outline whose width decreases towards the upper base.

In another possible embodiment the elevation which projects from the lower base of the supporting legs is formed by a separate piece, independent of the leg itself.

BRIEF DESCRIPTION OF THE DRAWINGS

For a better understanding of all that is described in this specification some drawings are attached in which, solely by way of example, a practical case of embodiment of the platform is shown.

In said drawings, FIG. 14 is a perspective view of an exploded representation of the components of the platform; FIG. 15 is an elevation detail of two platforms stacked on a work table, shown in sectioned form, and a third platform separated from them; FIG. 16 is a longitudinal section view of a platform with the legs provided with a hollow column; FIG. 17 is a longitudinal section detail of a platform provided with a separate column in its interior; and FIG. 18 is a longitudinal section detail of two superimposed platforms showing the cut in the side to facilitate gripping with the fingers.

DESCRIPTION OF A PREFERRED EMBODIMENT

Figure 1:
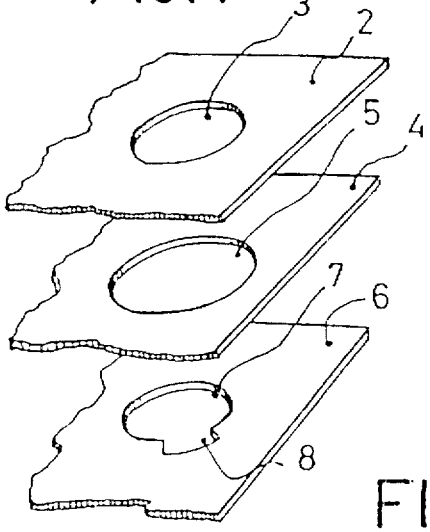
FIG. 1 is a perspective view of some fragments of the three layers which form the plate of the platform, with corresponding circular openings.
Figure 2:
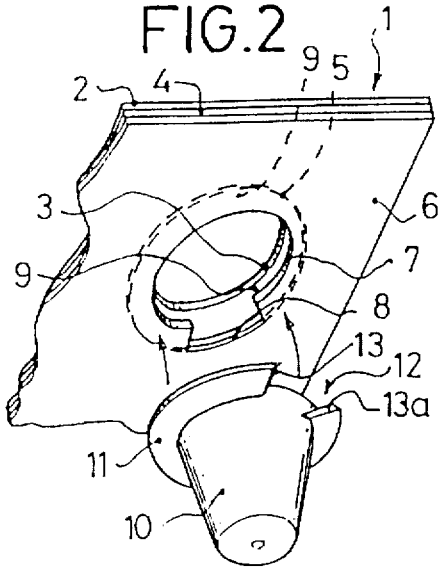
FIG. 2 is a lower perspective view of a fragment of the plate with a leg separated from the corresponding opening.

FIGS. 1 to 8 of the drawings illustrate an example of a platform with circular openings and truncopyramidal legs with a circular crown-shaped fin. FIGS. 9 to 13 illustrate an example of a platform with rectangular openings and truncopyramidal legs, provided with a rectangular fin of "U" shape, while FIGS. 14 to 18 show a variant of a platform.

In the views of FIGS. 1 to 8, the platform, of general reference 1, comprises three layers of cardboard or similar material, superimposed upon and glued to each other in the following manner: an upper layer 2 with regularly distributed circular openings 3; an intermediate layer 4 with circular openings 5 of larger diameter, matching the openings 3; and a lower layer 6, with openings 7 practically identical to the openings 3 of the first layer 2, but with a notch or prolongation 8. These openings also match the openings 3 and 5 described.

As the opening 5 of the intermediate layer 4 is of larger diameter than openings 3 and 7, a space 9 is defined between the layers 2 and 6 in the form of a circular crown.

In this embodiment, the platform 1 is provided with truncoconical hollow legs 10, with a circular crown-shaped external fin 11, with an incut 12 limited by two edges provided with inclined planes 13, 13*a* roughly parallel to each other. More specifically, the edge 13*a* is bent in the form of an inclined ramp. The legs 10 have reinforcement ribs 14 to their interior. The fin 11 is set slightly away from one edge 15 of the larger base of the leg, so that between the edge and the fin there is a zone 16 equivalent to the thickness of the layer 2, so that, once the leg is coupled in the set of openings of the plate, the edge 15 is in coplanar position with respect to the external surface of the layer 2.

Figure 3:
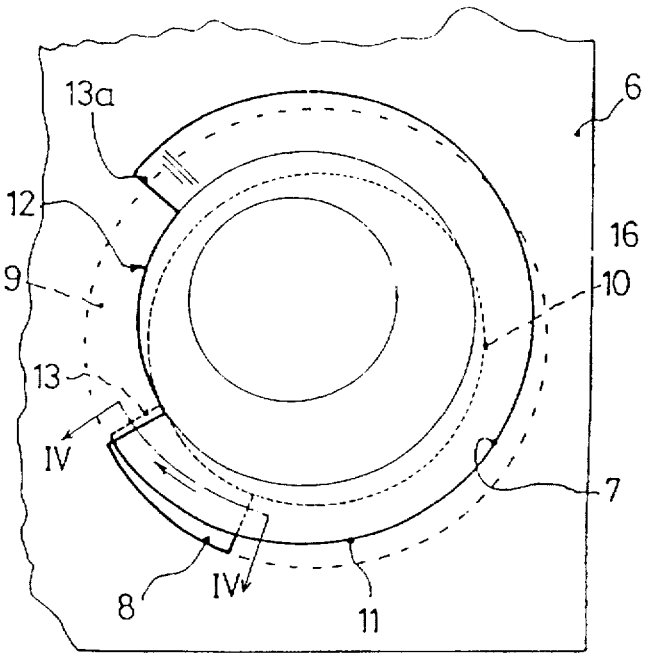
FIG. 3 is a plan view along the lower side of a fragment of the platform with an opening into which the circular fin of a truncoconical leg has begun to penetrate.
Figure 4:
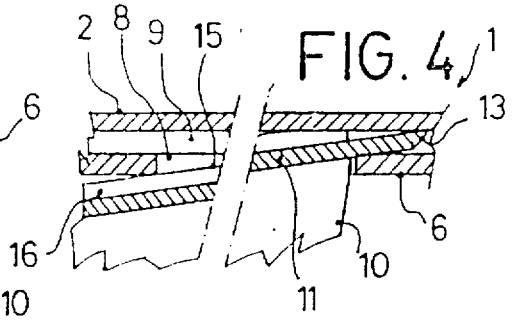
FIG. 4 is an enlarged detail in section along plane IV—IV of FIG. 3, showing penetration of the fin of the leg into the space around the opening of the plate.
Figure 5:
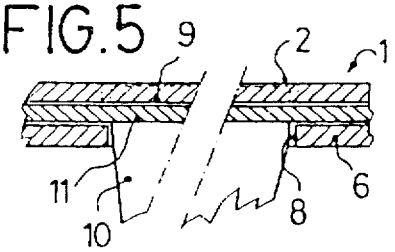
FIG. 5 is a view similar to that of FIG. 4, showing the fin of the leg trapped between the edges of the openings of the upper and lower layers of the plate.
Figure 6:
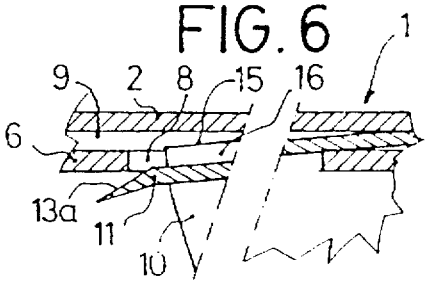
FIG. 6 is a view similar to those of FIGS. 4 and 5, illustrating removal of the fin.
Figure 7:
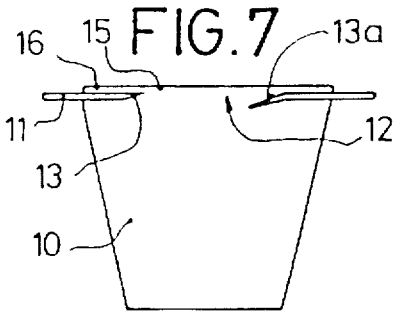
FIG. 7 is a front elevation view of a leg of the platform.
Figure 8:
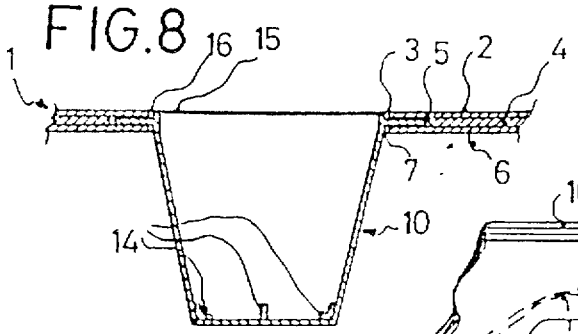
FIG. 8 is a longitudinal section view of a fragment of the platform with a leg fitted into the corresponding opening.
Figure 9:
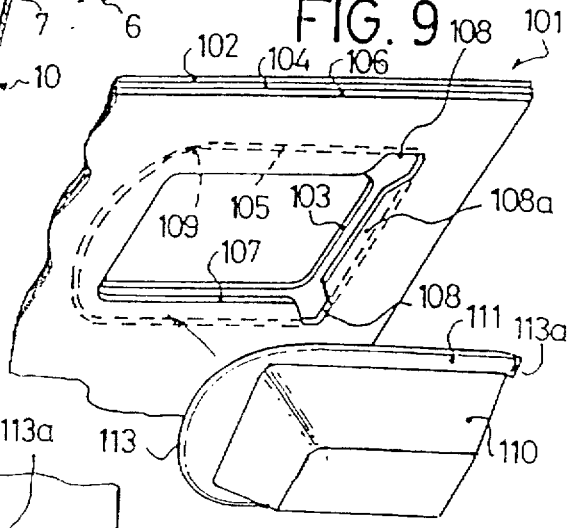
FIG. 9 is a perspective view from the lower side of a fragment of a plate with a rectangular opening and a detached truncopyramidal leg.
Figure 10:
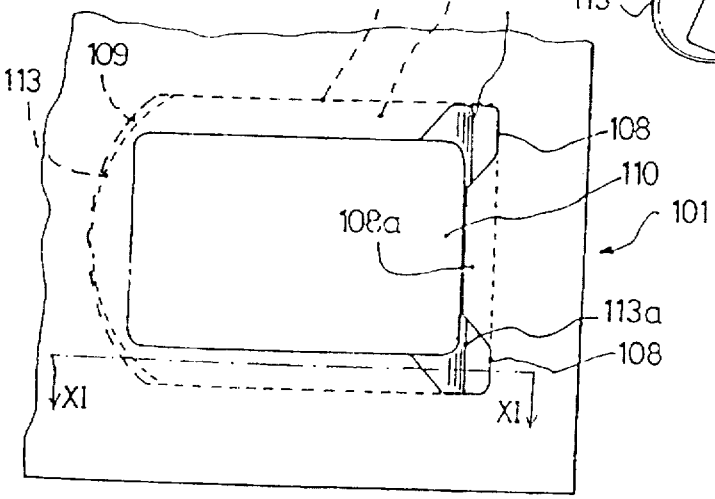
FIG. 10 is a plan view from the lower side of a fragment of the plate with the leg fitted into the space around the opening.

In order to fit each leg 10 into a set of openings 3,5,7 of the plate 1, the beveled edge 13 of the incut 12 of the fin 11 is introduced into the notch 8 of the lower opening 7 (FIGS. 3 and 4). The beveled edge 13 permits the thickness of the plate 6 to be overcome. A rotating movement, similar to screwing, is then imparted, so that the entire fin 11 is housed in the annular space 9 (FIGS. 5 and 8), trapped between the edges of the openings 3,7 of the layers 2,6.

In order to remove the leg 10, for the purpose of replacing it with a new one, a rotating movement is imparted in the opposite direction to that described. To permit extraction of the fin 11, the inclined ramp 13*a* (FIG. 6) permits the thickness of the plate 6 to be overcome without effort.

FIGS. 9 to 13 illustrate an example of platform 101 and dismountable leg 110 based on the same principle shown in FIGS. 8 to 13, but made with openings and fins of roughly rectangular shape and truncopyramidal legs. The platform 101 comprises three layers 102,104,106 superimposed and glued, with matching rectangular openings 103,105,107, of which the intermediate opening 105 is of larger dimensions in order to form an internal space 109 between the layers 103,106 limited by the edge of the opening 105.

Figure 11:
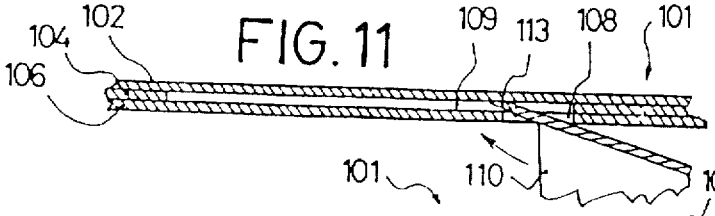
FIG. 11 is a longitudinal section detail along plane XI—XI of FIG. 10 as the fin is introduced into the intermediate space of the corresponding opening.
Figure 12:
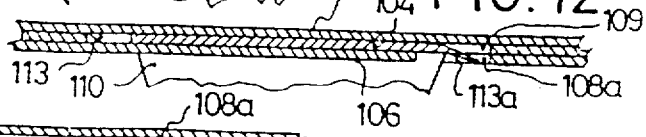
FIG. 12 is a view similar to that of FIG. 11, showing the fin housed in the intermediate space.
Figure 13:
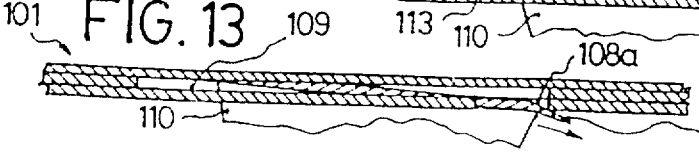
FIG. 13 is a view similar to those of FIGS. 11 and 12, showing the fin projecting from the housing.

The legs 110 are provided with an external radial fin 111 with an outline like a "U", which surrounds the two larger sides of the upper base of the leg and one of the smaller sides. The edge of the smaller side of the fin has a beveled edge 113 to facilitate entry into the space 109 by some notches 108 (FIG. 11). Between the notches 108 is formed a flexible wing 108*a*, which acts as a stop to immobilize the leg 110 once it has been fitted into the openings of the plate. On the opposite side the wing is interrupted and its ends form a ramp or slide 113*a* which facilitates removal of the leg 110 when it has to be changed (FIG. 13).

Once the leg 110 has been incorporated into the corresponding set of openings, its fin 111 is trapped between the edges of the openings 103,105,107 and by the edge of the wing 108*a* (FIGS. 10 and 12), preventing it coming out accidentally. This fin has to be pressed inwards in order to facilitate removal of the leg 110. FIGS. 14 to 18 show an embodiment of a platform 213 which comprises a first layer 201 of cardboard, "tablex" or other similar material with a certain degree of rigidity, with regularly distributed openings 202, with a corresponding number of notches 202*a*. Preferably, the lower side of this layer is impermeable.

Into the openings 202 are incorporated as the same number hollow legs 203 of inverted truncoconical shape, with a perimetral fin 204 near the upper open base 203*a* of the leg 202, provided with an incut, not visible in these FIGS. 14 to 18, equivalent to the incut 12 of FIGS. 1 to 7. The diameter of this fin is greater than that of the openings 202, so that the legs 203 are suspended in the layer 201 thanks to their fins.

According to the embodiment of the legs shown in FIG. 16 of the drawings, these are provided with a hollow, truncoconical internal elevation 205, with the lower base 205*a* open and the upper base 205*b* situated at the same height as the open side 203*a* of the leg 203, forming overall a single-piece moulded body.

In the embodiment shown in FIG. 17, the legs 203 have a separate column 206 incorporated into them, with a centring system based on a lower alveolus of the column and a projection from the lower base of the leg shown, of general reference 207. The upper base 206*a* of the column 206 is at the same height as the open side 203*a* of the leg 203.

Onto the first layer 201 is glued a second layer 208 with openings 209 of larger diameter than that of openings 202, which correspond with the peripheral fins 204, surrounded by the openings 209.

Onto the layer 208 is glued a third layer 210 with openings 211 identical to openings 202, but without notches, so that the legs 203 are trapped between layers 201 and 210 by means of the peripheral fins 204. Advantageously, the upper side of layer 210 is impermeabilized.

The whole formed by layers and legs constitutes the platform 213 which can be stacked when empty, or during its manufacturing process, not applicable here, shown in a final phase in FIG. 15, which shows a work table 214 on which two platforms are stacked one on top of the other and a third platform is separate from these.

The layers 201,208 of each platform 213 have on two of their edges two matching incuts 215,216 to form recesses 217 which facilitate gripping the stacked platforms (FIG. 18).

In relation to the legs 203 of the platforms 213, the presence of reinforcement columns should be noted in two versions: that shown in FIG. 16, formed by a body 205 moulded as a single piece with the leg 203 itself, and that shown in FIG. 17 formed by a separate piece 206. In any case, the columns mean the existence of an upper zone 205*b* or 206*a* which is coplanar with respect to the open base 203*a* of the leg 203, thereby increasing the rigid supporting surface of the load placed on the platform.

The most important advantages of the platform described, in any of the three embodiments thereof shown, are:

The legs 10,110,203 have only one fin 11,111,204, so that manufacturing of same is simpler and costs less than in other previous embodiments.

The fins of the legs can be circular, as in embodiment 11, or rectangular, as in embodiment 111, or any other similar shape, which provides more possibilities for the manufacturing of different types of legs, whether truncoconical, 10,203, or truncopyramidal, 110.

The fact that the legs can be detached from the plate facilitates recycling of the platform, once same has been rejected, since the plate and the legs will usually be made of different materials. Indeed, the plate 1,101, 210 can be made of cardboard, an agglomerate of "tablex" cellulosic material, or other similar material, even impermeabilized, while the legs 10,110,203 can be of thermoplastic material.

The platforms stacked with the legs 203 slotted in can be separated easily thanks to the incuts 217 provided on their edges.

The legs 203 can be reinforced with internal columns 205*b* or 206.

We claim:

1. Loading platform with dismountable legs, comprising a first layer of material having openings therein, a second layer of material having openings therein aligning with said openings in said first layer, said second layer being arranged under said first layer, a third layer of material having openings therein aligning with said openings in said first and second layers, said third layer being arranged under said second layer, each of said openings in said second layer being larger than the aligned one of said openings in said first layer and the aligned one of said openings in said third layer such that internal spaces are formed between said first and third layers, said third layer including at least one notch directed outward from each of said openings and underlying a portion of the respective one of said internal spaces, and dismountable legs, each having a radial fin arranged on an outer surface thereof which has an incut such that edges of said fin are opposite one another, said fin of each of said legs being structured and arranged to be passed through said at least one notch of a respective one of said openings in said third layer into a respective one of said internal spaces such that when said fin is situated in said respective internal space, lateral sides of said fin abut against a portion of said first and third layers defining said respective internal space and said fin is thereby retained in said respective internal space between said first and third layers.

2. The loading platform of claim 1, further comprising adhesive means for coupling said first layer to said second layer and said second layer to said third layer.

3. The loading platform of claim 1, wherein said edges of each of said fins is sloped.

4. The loading platform of claim 1, wherein said first, second and third layers are made of cardboard.

5. The loading platform of claim 1, wherein said openings in said first, second and third layers are regularly distributed throughout said first, second and third layers.

6. The loading platform of claim 1, wherein each of said openings in said first layer is essentially identical in shape and size to an aligning one of said openings in said third layer, each of said openings in said second layer being essentially identical in shape to the aligning ones of said openings in said first and third layer.

7. The loading platform of claim 1, wherein said openings in said first, second and third layers are substantially circular and said legs have a trunco-conical frame defining a hollow interior, said fins having a circular shape.

8. The loading platform of claim 7, further comprising reinforcement ribs arranged in said hollow interior of each of said legs.

9. The loading platform of claim 1, wherein at least one of said edges of each of said fins is bent to form a ramp.

10. The loading platform of claim 1, wherein said legs have an upper edge, each of said fins being spaced a distance from said upper edge of a respective one of said legs, said distance being equal to a thickness of said first layer.

11. The loading platform of claim 1, wherein said openings in said first, second and third layers are substantially rectangular, said at least one notch in said third layer comprising a pair of said notches arranged along one side of each of said rectangular openings, said third layer further including a flexible wing arranged between each pair of said notches and structured and arranged to immobilize a respective one of said legs once said respective leg is situated in said respective internal space, each of said fins surrounding said respective leg and being U-shaped.

12. The loading platform of claim 11, wherein said edges of each of said fins is bent to form a ramp.

13. The loading platform of claim 11, wherein said legs have a rectangular trunco-pyramidal frame having a large base, a small base, a pair of large sides and a pair of small sides, each of said fins being arranged to project around said large base of said rectangular trunco-pyramidal frame of said respective leg along said large sides and one of said small sides of said rectangular trunco-pyramidal frame such that the other of said small sides is not surrounded by said fin.

14. The loading platform of claim 1, wherein at least one of said first, second and third layer includes an incut on an edge thereof forming a recess to facilitate gripping of the platform.

15. The loading platform of claim 1, wherein said second and third layers each include an incut on an edge thereof forming a recess to facilitate gripping of the platform, said incut on said second layer and said incut on said third layer being arranged in correspondence with one another.

16. The loading platform of claim 1, wherein each of said legs includes a lower base, an upper edge and a column projecting from said lower base toward said upper edge in an interior of said leg.

17. The loading platform of claim 16, wherein said column in each of said legs includes an upper base coplanar with said upper edge of said leg.

18. The loading platform of claim 17, wherein said column in each of said legs is hollow, forms a single body molded with said leg, and has a width decreasing from said lower base of said leg to said upper base of said column.

19. The loading platform of claim 16, wherein said column in each of said legs is formed by a separate piece independent of said leg.

20. Method for forming a loading platform with dismountable legs, comprising the steps of:

providing a first layer of material having openings therein, adhesively bonding a top surface of second layer of material having openings therein to a bottom surface of said first layer such that said openings in said second layer align with said openings in said first layer, adhesively bonding a top surface of third layer of material having openings therein to a bottom surface of said second layer such that said openings in said third layer align with said openings in said second layer and thus said openings in said first layer, dimensioning said openings in said second layer to be larger than the aligned one of said openings in said first layer and the aligned one of said openings in said third layer to thereby form internal spaces between said first and third layers, arranging at least one notch directed outwardly from each of said openings in said third layer and underlying a portion of the respective one of said internal spaces, and providing dismountable legs, each having a radial fin arranged on an outer surface thereof which has an incut such that edges of said fin are opposite one another, said fin of each of said legs being structured and arranged to be passed through said at least one notch of a respective one of said openings in said third layer into a respective one of said internal spaces such that when said fin is situated in said respective internal space, lateral sides of said fin abut against a portion of said first and third layers defining said respective internal space and said fin is thereby retained in said respective internal space between said first and third layers.

* * * * *

UNITED STATES PATENT AND TRADEMARK OFFICE

CERTIFICATE OF CORRECTION

PATENT NO. : 5,799,586

DATED : September 1, 1998

INVENTOR(S) : Jaime TEIXIDOR CASANOVAS, et al.

It is certified that error appears in the above-identified patent and that said Letters Patent is hereby corrected as shown below:

On the title page: ITEM [54] and Column 1, line 4,

"LOADING PLATFORM WITH DISMOUNTABLE LEGS AND METHOD FOR MANUFACTURING LOADING PLATFORMS WITH DISMOUNT LEGS" to

--LOADING PLATFORM WITH DISMOUNTABLE LEGS AND METHOD FOR MANUFACTURING LOADING PLATFORMS WITH DISMOUNTABLE LEGS--.

Signed and Sealed this

Eighth Day of December, 1998

*Attest:*

*Attesting Officer*

Bruce Lehman

BRUCE LEHMAN

*Commissioner of Patents and Trademarks*